US009772586B2

(12) United States Patent
Matsubara et al.

(10) Patent No.: US 9,772,586 B2
(45) Date of Patent: Sep. 26, 2017

(54) IMAGE HEATING DEVICE FOR POSITIONING A HIGH THERMAL CONDUCTIVE MEMBER

(71) Applicant: CANON KABUSHIKI KAISHA, Tokyo (JP)

(72) Inventors: Hideyuki Matsubara, Mishima (JP); Hideaki Yonekubo, Suntou-gun (JP); Hisashi Nakahara, Numazu (JP); Akira Kato, Mishima (JP); Noriaki Tanaka, Suntou-gun (JP); Yasuhiro Shimura, Yokohama (JP); Yuji Fujiwara, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/553,868

(22) Filed: Nov. 25, 2014

(65) Prior Publication Data

US 2015/0153692 A1 Jun. 4, 2015

(30) Foreign Application Priority Data

Nov. 29, 2013 (JP) ..... 2013-248454

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC ..... G03G 15/2053; G03G 15/2042; G03G 2215/2035
USPC ..... 399/329
See application file for complete search history.

(56) References Cited

U.S. PATENT DOCUMENTS

| | | | | |
|---|---|---|---|---|
| 2009/0230114 | A1* | 9/2009 | Taniguchi | G03G 15/2042 219/216 |
| 2012/0121303 | A1 | 5/2012 | Takagi | |
| 2014/0138372 | A1* | 5/2014 | Ogura | G03G 15/2042 219/216 |

FOREIGN PATENT DOCUMENTS

| | | | |
|---|---|---|---|
| CN | 102540838 | A | 7/2012 |
| JP | H09-166927 | A | 6/1997 |
| JP | 2001-356623 | A | 12/2001 |
| JP | 2002-050452 | A | 2/2002 |
| JP | 2003-005573 | A | 1/2003 |
| JP | 2003-257592 | A | 9/2003 |

(Continued)

*Primary Examiner* — David M Gray
*Assistant Examiner* — Michael Harrison
(74) *Attorney, Agent, or Firm* — Canon U.S.A. Inc., IP Division

(57) ABSTRACT

An image heating device includes, a moving member configured to move while contacting a recording material at one surface of the moving member, a backup member configured to contact the other surface of the moving member, a holding member configured to hold the backup member, a nip portion forming member contacting the one surface of the moving member, and configured to form a nip portion in corporation with the backup member via the moving member, and a high thermal conductive member held between the holding member and the backup member, wherein the recording material on which an image has been formed is heated by heat received from the moving member while being nipped and conveyed at the nip portion, and wherein the holding member includes a recessed portion configured not to apply pressure to the high thermal conductive member.

14 Claims, 12 Drawing Sheets

(56) References Cited

FOREIGN PATENT DOCUMENTS

| | | | |
|---|---|---|---|
| JP | 2003-272806 | A | 9/2003 |
| JP | 2003-317898 | A | 11/2003 |
| JP | 2005-181989 | A | 7/2005 |

* cited by examiner

IMAGE HEATING DEVICE FOR POSITIONING A HIGH THERMAL CONDUCTIVE MEMBER

BACKGROUND OF THE INVENTION

Field of the Invention

The present invention relates to an image heating device to be preferably used as a fixing device provided in an image forming apparatus such as an electrophotographic copying machine and electrophotographic printer.

Description of the Related Art

In an image forming apparatus having an image heating device, when print processing is sequentially performed on a small-size recording material of a width narrower than a width of a recording material of a maximum width usable in the apparatuses, a phenomenon in which a temperature of the non-sheet passing part of a fixing unit rises (i.e., non-sheet-passing part temperature rise), occurs. In the technical field of film-heating fixing devices using a fixing film and a ceramic heater contacting the fixing film, as a method for reducing the non-sheet-passing part temperature rise, a method discussed in Japanese Patent Application Laid-Open No. 2003-317898 is proposed. In this method, a high thermal conductive member is held between a holding member for holding a heater and the heater to reduce unevenness in the temperature distribution of the heater.

Meanwhile, in assembling the apparatus, if a position of the high thermal conductive member is misaligned to the heater, temperatures at end portions in a longitudinal direction of the heater may decrease and this may deteriorate the fixation properties, and/or the effects of reducing the temperature rise in the non-sheet-passing part by the high thermal conductive member may decrease. Especially, when a thin sheet is used as the high thermal conductive member, the handling of the sheet is difficult, and consequently, at the time of assembly, it is difficult to determine the position of the sheet to the heater.

SUMMARY OF THE INVENTION

The present invention is directed to an image heating device in which a high thermal conductive member can be easily positioned.

According to an aspect of the present invention, an image heating device includes, a moving member configured to move while contacting a recording material at one surface of the moving member, a backup member configured to contact another surface of the moving member, a holding member configured to hold the backup member, a nip portion forming member contacting the one surface of the moving member, and configured to form a nip portion in corporation with the backup member via the moving member, and a high thermal conductive member held between the holding member and the backup member, wherein the recording material on which an image has been formed is heated by heat received from the moving member while being nipped and conveyed at the nip portion, and wherein the holding member includes a holding surface configured to hold the backup member via the high thermal conductive member, and a recessed portion provided adjacent to the holding surface in a direction orthogonal to a recording material conveyance direction, and configured not to apply pressure to the high thermal conductive member, or to reduce the pressure to be applied to the high thermal conductive member as compared to the holding surface.

According to another aspect of the present invention, an image heating device includes, a cylindrical film, a heater contacting the inner surface of the film, a holding member configured to hold the heater, a nip portion forming member configured to form a nip portion in cooperation with the heater via the film, and a graphite sheet held between the holding member and the heater, wherein a recording material on which an image has been formed is heated by heat received from the film while being nipped and conveyed at the nip portion, and wherein the holding member includes a holding surface configured to hold the heater via the graphite sheet, and a recessed portion provided adjacent to the holding surface in a direction orthogonal to a recording material conveyance direction, and configured not to apply pressure to the graphite sheet, or to reduce the pressure to be applied to the graphite sheet as compared to the holding surface.

Further features of the present invention will become apparent from the following description of exemplary embodiments with reference to the attached drawings.

DESCRIPTION OF THE EMBODIMENTS

Various exemplary embodiments, features, and aspects of the invention will be described in detail below with reference to the drawings.

Figure 1:
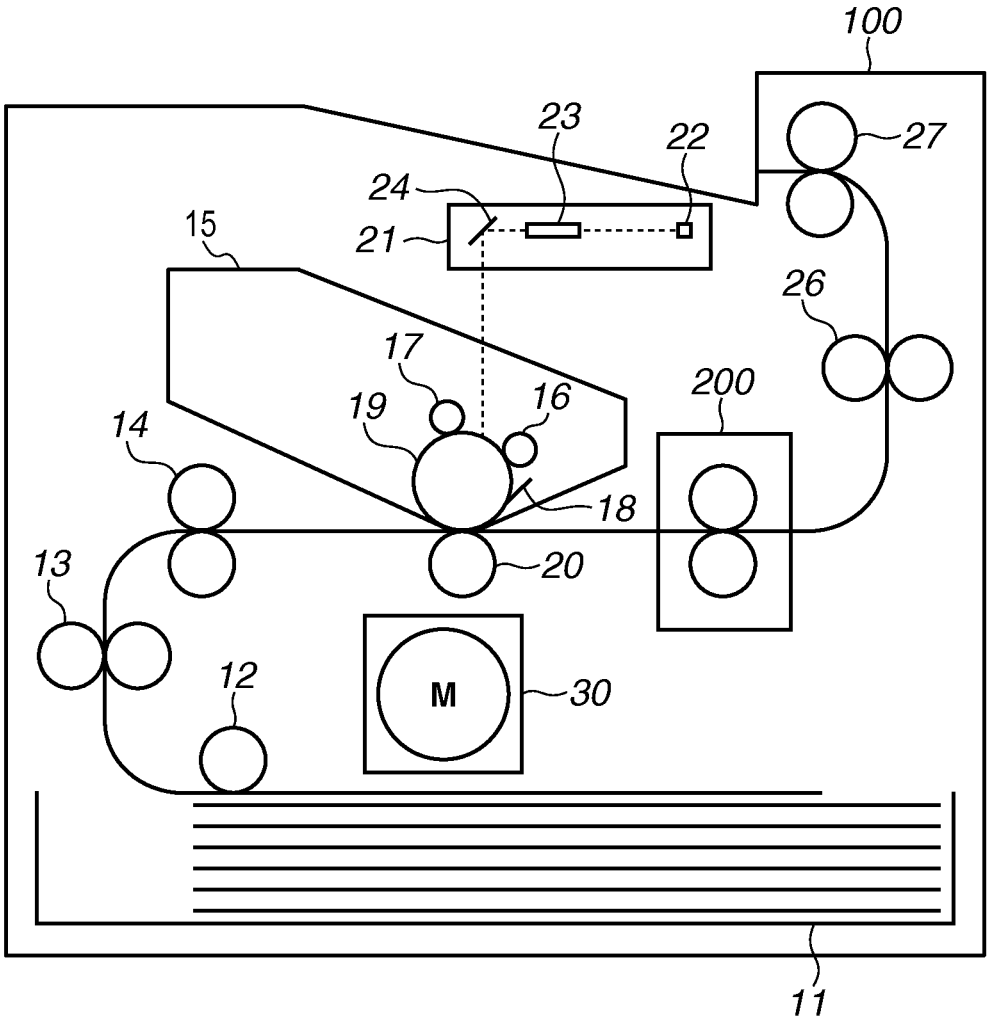
FIG. 1 illustrates an image forming apparatus according to an exemplary embodiment of the present invention.

FIG. 1 is a cross-sectional view illustrating a laser printer (image forming apparatus) 100 employing an electrophotographic recording technique. When a print signal is produced, a semiconductor laser 22 emits a laser beam modulated according to image information. The laser beam is deflected by a polygonal mirror 23, and exits from a scanner unit 21 via a reflecting mirror 24. With the laser beam, a photosensitive member 19 charged in a predetermined polarity by a charging roller 16 is scanned. This processing forms an electrostatic latent image on the photosensitive member 19. To the electrostatic latent image, toner is supplied from a development unit 17, and a toner image corresponding to the image information is formed on the photosensitive member 19. Meanwhile, recording paper (recording material) P stacked in a sheet cassette 11 is fed one by one by a pickup roller 12, and conveyed toward registration rollers 14 by rollers 13. The recording paper P is conveyed from the registration rollers 14 to a transfer position at the timing the toner image on the photosensitive member 19 arrives at the transfer position formed by the photosensitive member 19 and a transfer roller 20. While the recording paper P passes through the transfer position, the toner image on the photosensitive member 19 is transferred onto the recording paper P. Then, the recording paper P is heated by a fixing device (image heating device) 200 and the toner image is fixed by heating onto the recording paper P. The recording paper P bearing the fixed toner image is discharged by rollers 26 and 27 onto a tray provided at an upper part of the printer. A cleaner 18 is used to clean the photosensitive member 19. A motor 30 drives the fixing device 200 and other components. An image forming unit for forming an unfixed image onto the recording paper P includes the above-described photosensitive member 19, the charging roller 16, the scanner unit 21, the development unit 17, and the transfer roller 20. A cartridge 15 includes the charging roller 16, the development unit 17, the photosensitive member 19, and the cleaner 18. The cartridge 15 can be attached to or removed from the image forming apparatus body.

The laser printer 100 according to the present exemplary embodiment can handle a plurality of sizes. More specifically, the laser printer 100 can perform printing on paper of a plurality of sizes including a letter-size paper (approximately 216 mm×279 mm), an A4-size paper (210 mm×297 mm), or an A5-size paper (148 mm×210 mm) set in the sheet cassette 11. The laser printer 100 basically performs longitudinal paper feed (conveys paper such that the long sides of the paper are parallel to the conveyance direction), and the largest (widest) size in the usable standard recording material sizes (the usable paper sizes in a catalog) is a width of approximately 216 mm of the letter size paper. Papers (e.g., the A4-size paper and the A5-size paper) of narrower widths than the maximum size usable by the laser printer 100 is defined as small size paper.

Figure 2A:
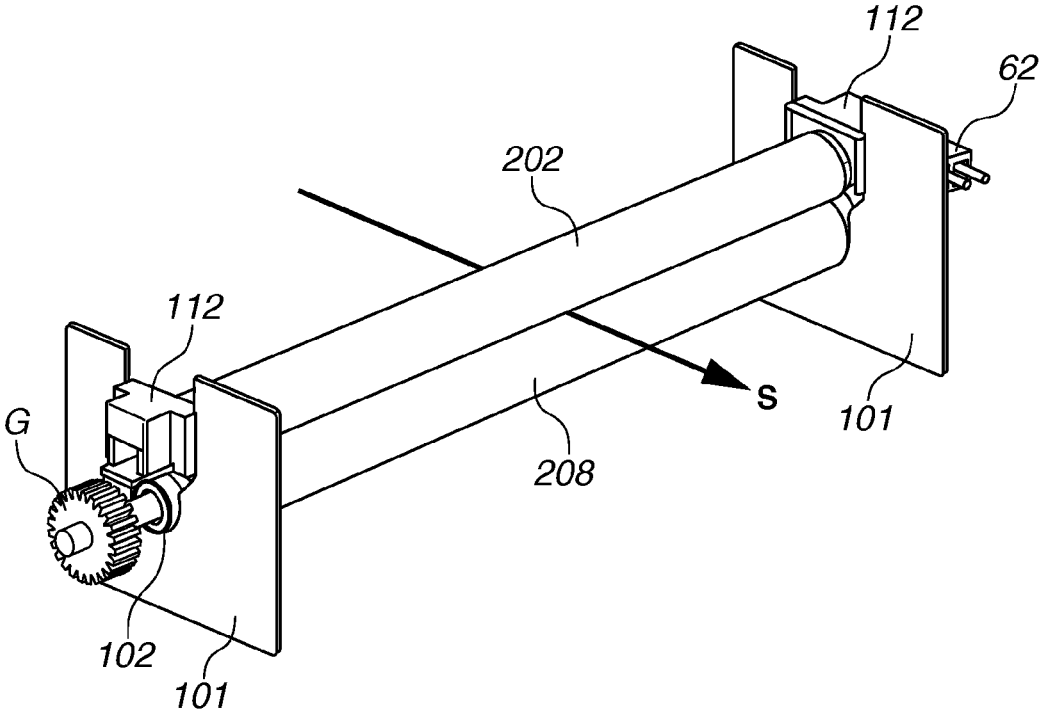
FIG. 2A is a perspective view illustrating a fixing unit.
Figure 2B:
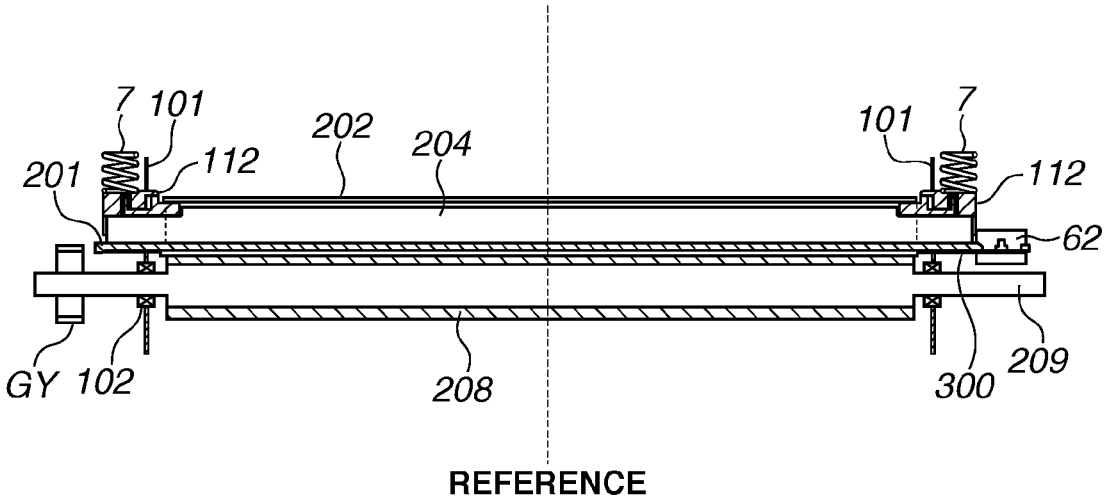
FIG. 2B is a cross-sectional view illustrating the fixing unit.
Figure 3A:
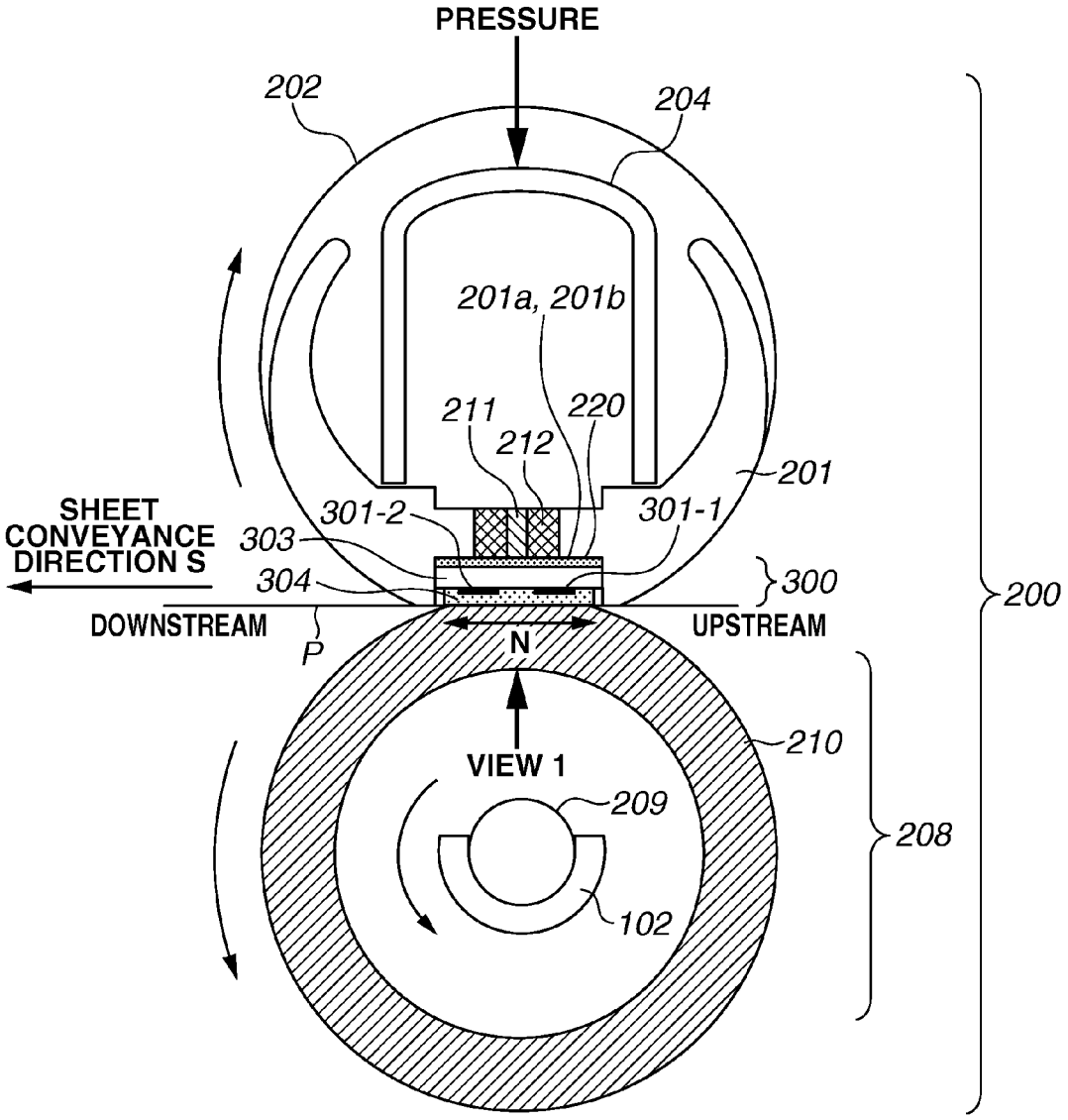
FIG. 3A is a cross-sectional view illustrating the fixing unit.

FIG. 2A is a perspective view illustrating the fixing unit (image heating device) 200, and FIG. 2B is a cross-sectional view illustrating the fixing unit viewed from the upstream side in the recording paper conveyance direction. FIG. 3A is a cross-sectional view illustrating the fixing unit. The line (reference) illustrated in FIG. 2B indicates a conveyance reference for recording paper. Recording paper is conveyed such that the center in the width direction of the recording paper is aligned with the line (reference). The arrow S in FIGS. 2A and 3A indicates the conveyance direction of the recording paper.

The fixing unit 200 includes a cylindrical film (moving member) 202, a heater (backup member) 300 that contacts the inner surface of the film 202, and a pressure roller (nip portion forming member) 208 that forms a fixing nip portion N with the heater 300 via the film 202. The base layer of the film 202 is formed of a heat-resistant resin such as polyimide or metal such as stainless steel. The pressure roller 208 includes a core bar (shaft) 209 formed of, for example, iron or aluminum, and an elastic layer 210 formed of, for example, a silicone rubber. The heater 300 is held by a heater holding member 201 formed of a heat-resistant resin. The heater holding member 201 has a guide function of guiding the rotation of the film 202. The heater holding member 201 is an elongated member for holding the heater in the longitudinal direction of the heater. The pressure roller 208 receives power from the motor 30 through a gear GY provided at an end portion of the shaft 209 and rotates in the direction indicated by the arrow. The rotation of the pressure roller 208 causes the film 202 to follow the rotation of the pressure roller 208 to rotate. A metallic stay 204 is used to apply pressure of a spring 7 to the heater holding member 201. The stay 204 also has a function to reinforce the heater holding member 201. The stay 204 is an elongated member provided in parallel with the heater holding member 201. At both ends of the stay 204, regulating members 112 for regulating the deviation movement of the film 202 to the generating line direction are provided. The force of the spring 7 is applied to the regulating members 112, the stay 204, the heater holding member 201, the heater 300, the film 202, and the pressure roller 208 in this order. A bearing 102 is provided to a frame 101 of the fixing unit 200. The bearing 102 rotatably holds the shaft 209 of the pressure roller 208. Consequently, between the pressure roller 208 and the heater holding member 201, through the stay 204, pressure for forming the fixing nip portion N is being applied. A connector 62 is used to supply electric power to the heater 300.

The heater 300 includes a ceramic heater substrate 303, and resistance heating elements (heating elements) 301-1 and 301-2 provided on the heater substrate 303 along the substrate longitudinal direction. The heater 300 further includes an insulating surface protective layer 304 (in the present exemplary embodiment, the insulating surface protective layer 304 is formed of glass) that covers the resistance heating elements 301-1 and 301-2.

Between the heater holding member 201 and the heater 300, a high thermal conductive member 220 is provided. The high thermal conductive member 220 has a higher thermal conductivity in the parallel direction to the plane of the high thermal conductive member 220 than the thermal conductivity of the heater substrate 303. For example, the high thermal conductive member 220 is a flexible sheet member using graphite. The opposite surface (rear surface) of the surface of the heater 300 facing the nip portion N contacts a thermistor (temperature detection element) 211 via the high thermal conductive member 220. The rear surface of the heater 300 also contacts, via the high thermal conductive member 220, a protective element 212 such as a thermoswitch and a temperature fuse that operates when temperature of the heater 300 abnormally rises to shut off the power supply to the heating elements 301-1 and 301-2. The thermistor 211 and the protective element 212 are pressed to the high thermal conductive member 220, for example, by a leaf spring (not illustrated). The recording paper P bearing an unfixed toner image is nipped and conveyed while being heated at the fixing nip portion N, and thereby the unfixed toner image is fixed. In the present exemplary embodiment, as the high thermal conductive member 220, a flexible sheet (tape) is used. More specifically, the Pyrolytic Graphite Sheet (PGS) (registered trademark) manufactured by Panasonic Corporation is used. The PGS has a thermal conductivity of 1000 W/mK in the direction parallel to the surface of the sheet, a thermal conductivity of 15 W/mK in the thickness direction, a thickness of 70 μm, and a density of 1.2 g/cm$^3$.

Figure 3B:
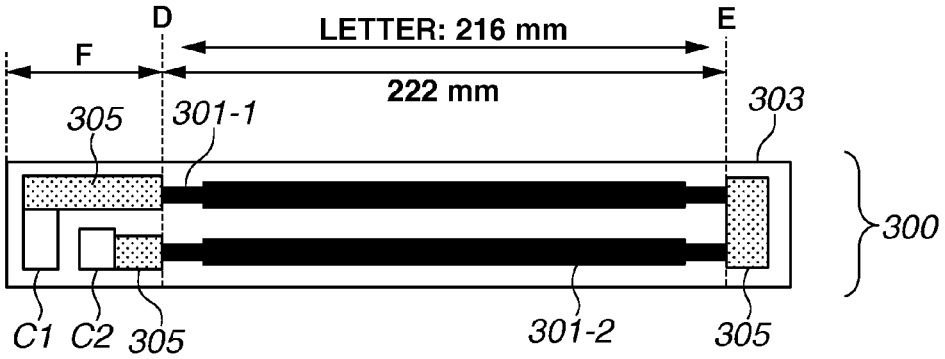
FIG. 3B is a plan view illustrating a heater.

FIG. 3B is a plan view illustrating the heater 300. The resistance heating elements 301-1 and the 301-2 are electrically connected in series through a conductive element 305. To the resistance heating elements 301-1 and 301-2, electric power is supplied from an electrode portion C1 and an electrode portion C2 through the conductive element 305, respectively. A heating area is from an end portion D to an end portion E of the heating element. A heat generation distribution in the longitudinal direction of the resistance heating elements 301-1 and 301-2 of the heater 300 is set to ensure end portion fixation properties of recording paper such that amounts of generated heat at the end portions are higher than amount of generated heat at a central portion (i.e., as illustrated in FIG. 3B, the heating element width at the end portions is narrower than the heating element width at the central portion). Hereinafter, the narrow portions of the resistance heating elements 301-1 and 301-2 are referred to as end-narrowed portions. A length of a section DE, which is a heating area, is 222 mm, and the length is longer than the maximum size paper (letter size: 216 mm) set in the apparatus according to the present exemplary embodiment. Consequently, the end portions of the letter-size paper pass through around the center of the end-narrowed portions of the heating elements.

As described above, the fixing device according to the present exemplary embodiment includes the film (moving member) 202 that moves while contacting the recording material at one surface, the heater (backup member) 300 that contacts the other surface of the moving member, and the holding member 201 for holding the backup member. The fixing device further includes the pressure roller (nip portion forming member) 208 that contacts one surface of the moving member and forms the nip portion with the backup member through the moving member, and the high thermal conductive member 220 that is held by the backup member and the holding member. Pressure is applied between the holding member 201 and the nip portion forming member 208, so that an image on the recording material is heated by the heat generated by the moving member while the recording material is nipped and conveyed with the nip portion N.

Figure 4:
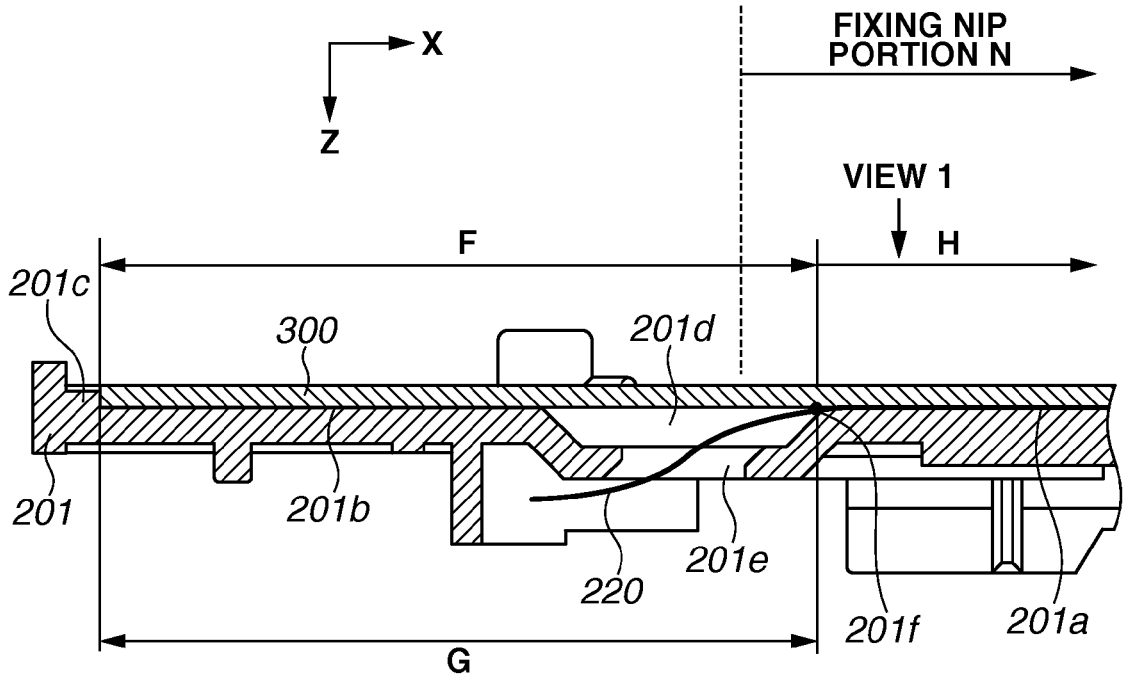
FIG. 4 is a cross-sectional view illustrating a relationship among a heater, a high thermal conductive member, and a heater holding member according to a first exemplary embodiment.
Figure 5A:
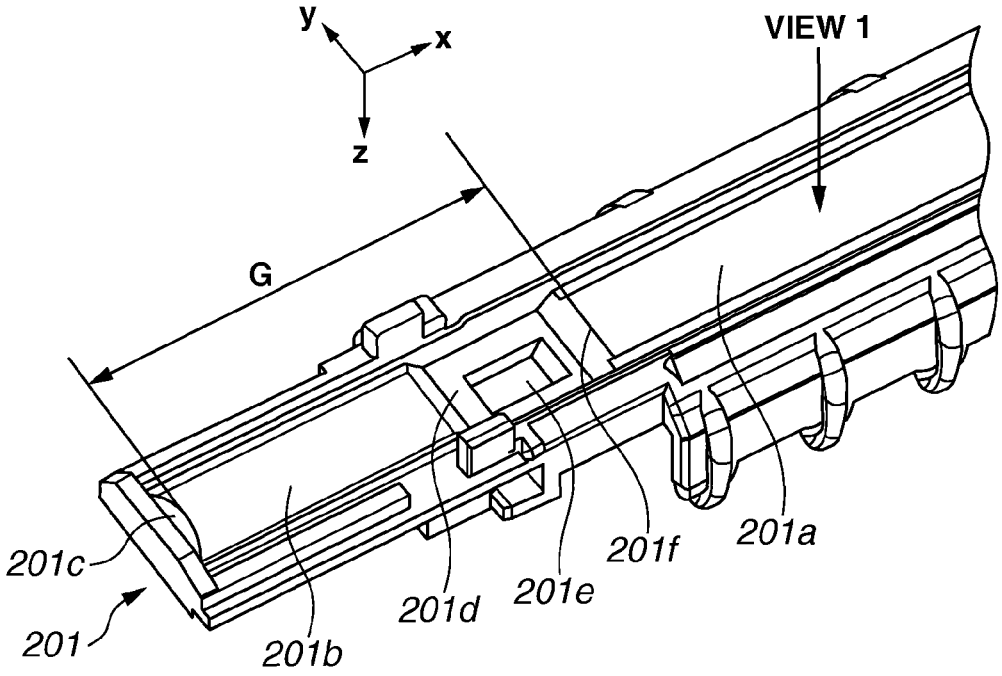
FIGS. 5A and 5B are perspective views illustrating a relationship between the high thermal conductive member and the heater holding member.
Figure 5B:
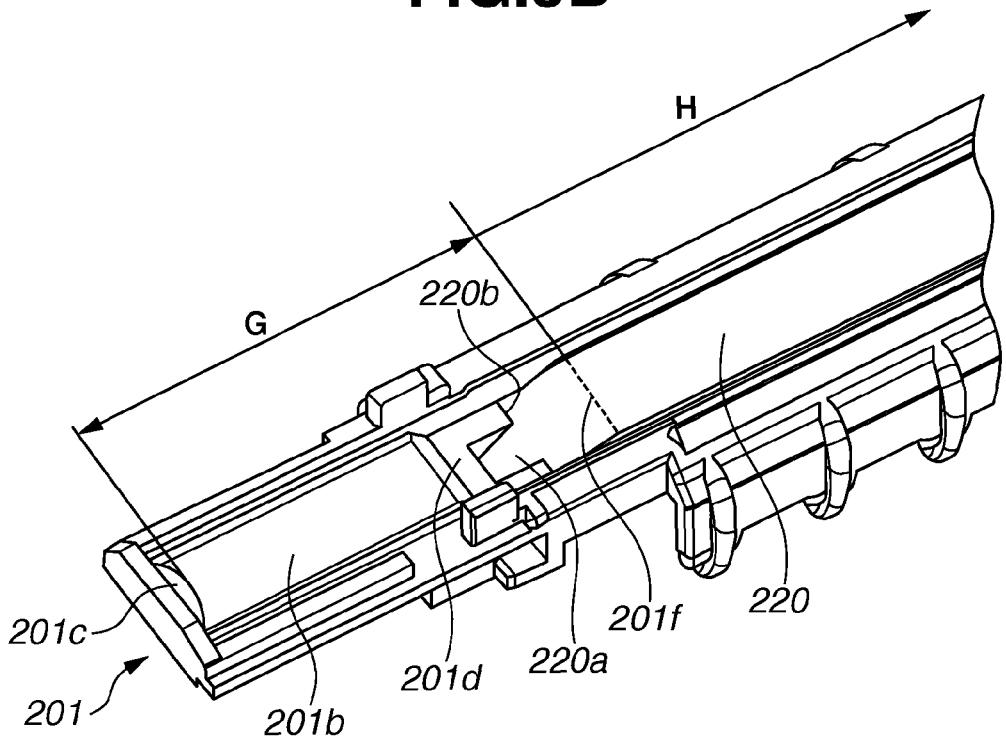

With reference to FIG. 4 and FIGS. 5A and 5B, a positional relationship among the heater holding member 201, the graphite sheet 220, and the heater 300 will be described. In the following description, description of one end portion will be made. However, description of the other end portion of the heater 300 is omitted since the other end portion has the same structure. The graphite sheet 220 is simply called as a sheet 220.

FIG. 4 is a cross-sectional view of the area of the end portion in the longitudinal direction (X direction) of the heater holding member 201. FIGS. 5A and 5B are perspective views of the area of the end portion in the longitudinal direction of the heater holding member 201. FIG. 5A illustrates only the heater holding member 201. FIG. 5B illustrates a state in which the sheet 220 is attached to the heater holding member 201. The heater 300 is disposed on the sheet 220 illustrated in FIG. 5B. The arrows view 1 in FIG. 3A, FIG. 4, and FIG. 5A indicate the same direction.

To the heater holding member 201, a heater attachment groove recessed in the z direction is provided. The bottom surface of the heater attachment groove includes an attachment surface (holding surface) 201*a* and an attachment surface (second holding surface) 201*b*. On the attachment surface 201*a*, the heater 300 is provided via the sheet 220. On the attachment surface 201*b*, the heater 300 is directly provided. To the x direction end portion of the heater holding member 201, an arc shape butting portion 201*c* against which the end portion of the heater 300 butts is provided. The butting portion 201*c* regulates a position in the longitudinal direction (x direction) of the heater 300 in the attachment groove of the heater holding member 201. To the heater holding member 201, a back clearance portion (recessed portion) 201*d* that is further recessed in the z direction than the heater attachment surface 201*a* is provided. More specifically, at a part of the surface of the holding member 201 contacting the high thermal conductive member 220, the recessed portion is provided to prevent application of pressure to the high thermal conductive member 220, or to reduce the pressure applied to the high thermal conductive member 220 as compared to the attachment surface 201*a*. The recessed portion is provided, with respect to the direction (x direction) orthogonal to the conveyance direction (y direction) of the recording material, adjacent to an area (an area H described below) where the pressure is applied to the high thermal conductive member 220. The recessed portion is provided, with respect to the direction (x direction) orthogonal to the conveyance direction, outside of the area (section DE) where the heating elements are positioned.

To the x direction end portion of the sheet 220, a portion 220*a* with a narrow width in the y direction is provided. The back clearance portion 201*d* has a hole 201*e* for passing the end portion 220*a* of the sheet 220 therethrough. The sheet 220 is provided such that the end portion 220*a* of the sheet 220 is passed through the hole 201*e*, thereby regulating the position of the sheet in the widthwise direction (y direction). Although a position of the sheet 220 in the x direction is regulated by the end portion 220*b* that is a border with the end portion 220*a*, the sheet 220 has a flexibility in the x direction since the hole 201*e* is wide in the x direction.

In a step prior to the attachment of the heater 300 to the heater holding member 201, as described above, the sheet 220 is regulated with respect to the heater holding member 201, while the sheet 220 has a flexibility in the longitudinal direction (the state illustrated in FIG. 5B). Then, the heater 300 is disposed on the sheet 220, and further, pressure is applied by the spring 7 and thereby the sheet 220 closely contacts the attachment surface 201*a* as well as the heater 300. In the case where the sheet 220 is very thin like the graphite sheet used in the present exemplary embodiment, it is difficult to attach the sheet 220 such that the sheet 220 closely contacts the entire area of the attachment surface 201*a* at the step prior to the attachment of the heater 300. In the present exemplary embodiment, however, the heater 300 is attached to the heater holding member 201, and the sheet 220 is allowed to closely contact the heater 300 and the attachment surface 201*a* by further applying pressure. Consequently, the positional regulation of the sheet in the x direction at the step of the attachment of the sheet may be roughly made, and thus the step of attaching the sheet 220 in the assembly of the apparatus is simplified. At the step prior to the attachment of the heater 300, the close contact area of the sheet 220 and the heater holding member 201 in the x direction has not been determined. The heater 300 is attached and further, pressure is applied by the spring 7 to determine the close contact area of the sheet 220 and the heater holding member 201 to be the area (area H) to a line 201*f*, which is an end portion (also, an end portion of the recessed portion 201*d*) of the attachment surface 201*a*. In other words, the positional relationship between the sheet 220 and the heater holding member 201 in the x direction is determined.

Next, a positional relationship between the sheet 220 and the heating area (the section DE in FIG. 3B) of the heater 300 will be described. A distance G from the heater butting portion 201*c* to the end portion line 201*f* of the attachment surface 201*a* of the heater holding member 201, and a distance F from the end portion to the heating area end portion of the heater 300 have been set to an approximately same distance (see FIGS. 3A and 3B to FIGS. 5A and 5B). Consequently, when the pressure is applied by the spring 7, the heating area (section DE) of the heater 300 in the x direction approximately corresponds to the area of the attachment surface 201*a*. In other words, the area H, (which corresponds to the area of the attachment surface 201*a*) where the sheet 220 is pressed by the spring 7, approximately corresponds to the heating area DE. As described above, when the delicate thin sheet is used, the heating area DE and the pressure area H of the sheet 220 can be accurately determined.

The sheet 220 has the function to reduce overheating of the non-sheet passing area in the process of fixing small size paper. If the close contact area of the sheet 220 with respect to the heater in the x direction is too wide, temperatures at the end portions of the heater can be excessively decreased. Consequently, in the present exemplary embodiment, the pressure area H and the heating area DE are set to have the same area. However, it is not always necessary to set the pressure area H and the heating area DE to have the same area, and the positional relationship between the areas may be appropriately set. According to the present exemplary embodiment, the pressure area H can be easily changed only by changing the shape of the heater holding member 201.

Figure 6:
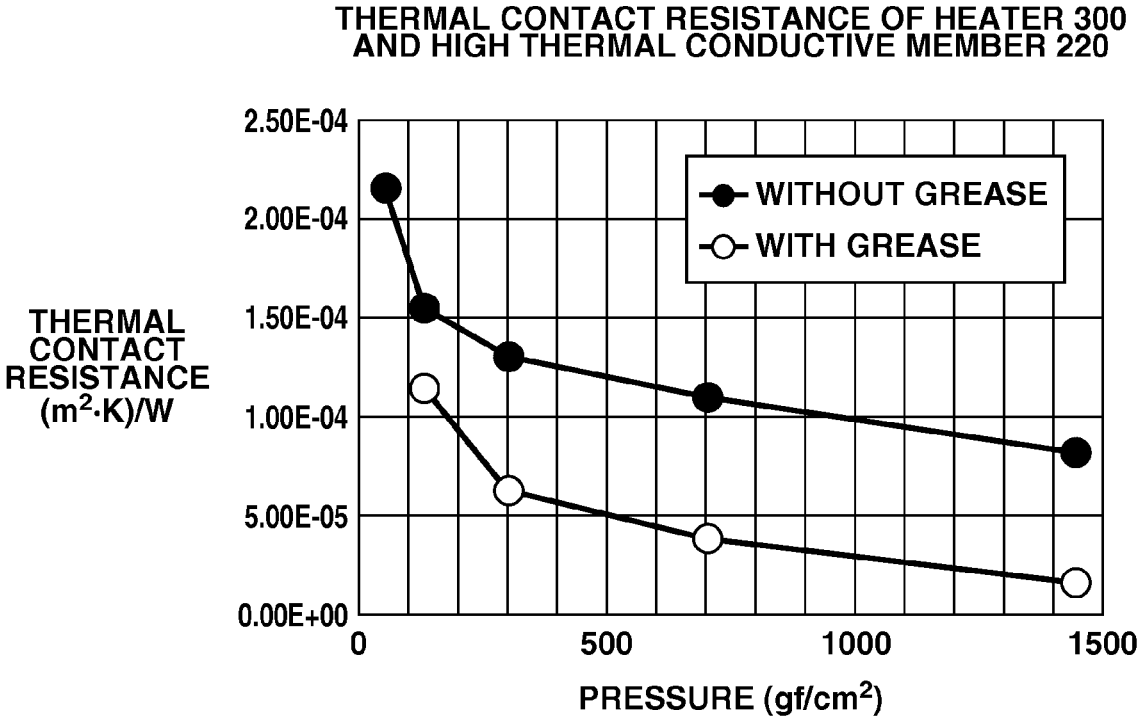
FIG. 6 illustrates a relationship of a thermal contact resistance between the heater and the high thermal conductive member with respect to a pressure.

FIG. 6 illustrates a relationship between pressure applied to the heater and the high thermal conductive member (in the present exemplary embodiment, the graphite sheet) and thermal contact resistance (thermal resistance of contact areas). Black circles (●) in FIG. 6 indicate a relationship between thermal contact resistance and applied pressure in a case where grease is not used between the sheet 220 and the heater 300. They indicate that when the pressure is not applied by the spring 7 to the sheet 220 and the heater 300, even though the sheet 220 and the heater 300 are in contact with each other, the heat conduction is very low. In other words, to produce heat conduction between the sheet 220 and the heater 300, predetermined pressure is to be applied to the sheet 220 and the heater 300 in addition to the contact state. Although the sheet 220 is in contact with the heater 300 in the recessed portion 201*d* illustrated in FIG. 4, in this area, no pressure is applied between the heater 300 and the sheet 220, and there is little heat conduction from the heater 300 to the sheet 220. In other words, as in the heater holding member according to the present exemplary embodiment, by providing the recessed portion 201*d*, the border 201*f* between the area H where the function of the sheet is performed and the area G where the function of the sheet is not performed can be formed.

White circles (○) in FIG. 6 indicates a relationship between thermal contact resistance and applied pressure in a case where MOLYKOTE (registered trademark) HP-300 GREASE (manufactured by Dow Corning Toray Co., Ltd.) that is a fluorinated grease is applied between the sheet material 220 and the heater 300. They indicate that with the grease between the sheet 220 and the heater 300, the thermal contact resistance between the sheet 220 and the heater 300 can be reduced. Consequently, a thermal conductive material such as grease may be applied between the sheet 220 and the heater 300. As an alternative to the grease, for example, a high thermal conductive adhesive material may be used.

Figure 7:
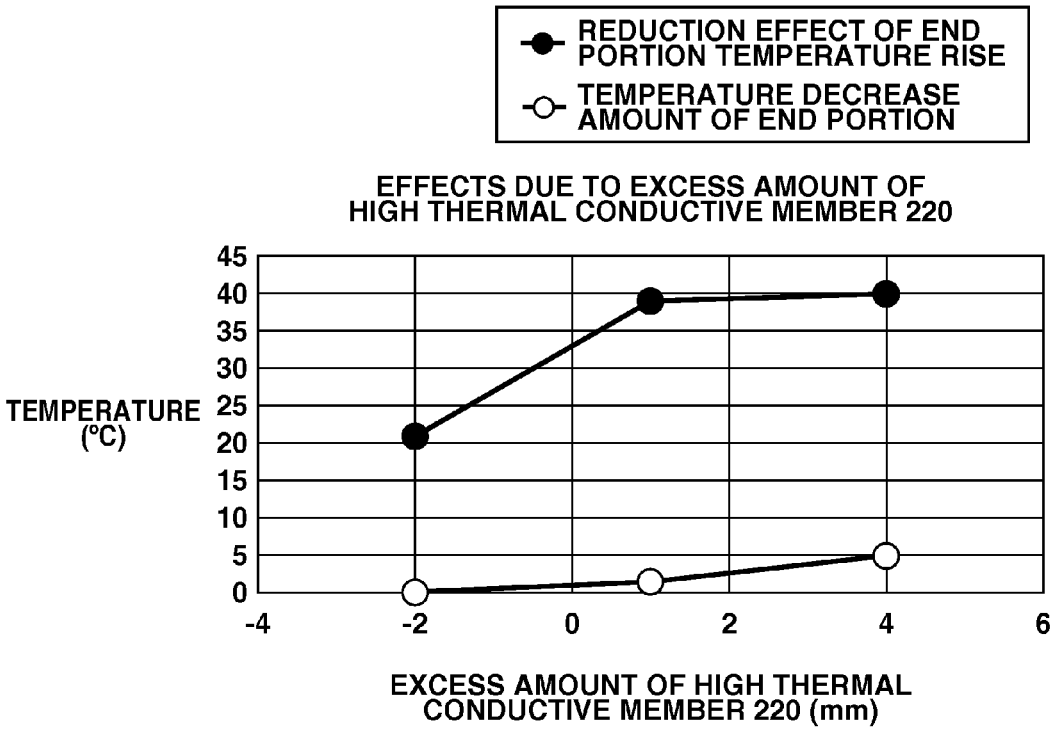
FIG. 7 illustrates a relationship between an excess amount of the high thermal conductive member and a reduction effect of an end portion temperature rise, and a relationship between the excess amount of the high thermal conductive member and a temperature decrease amount of the end portion.

FIG. 7 illustrates a reduction effect of the end portion temperature rise when small size paper is passed, and an amount of end portion temperature decrease in starting the fixing device by the use of the sheet 220. An excess amount of the sheet 220 indicates, with respect to the x direction, a length of the sheet pressure area exceeding the heating area DE. In a case where the sheet pressure area is wider than the heating area DE, the state is plus (+), and in a case where the sheet pressure area is narrower than the heating area DE, the state is minus (−). Black circles (●) in FIG. 7 indicate a relationship between the reduction effect of the end portion temperature rise of the heater 300 and an excess amount of the sheet 220 in a case where A4-size paper, so-called small size paper, is passed. They indicate that when an excess amount becomes minus, the temperature rise reduction effect decreases greatly. As a result, when the small size paper is passed, due to the heater end portion temperature rise, the productivity decreases. Consequently, to reduce the heater end portion temperature rise and increase the productivity, the excess amount should not be too small.

White circles (○) in FIG. 7 indicate a relationship between a temperature decrease amount of an end portion in starting the fixing device and an excess amount of the sheet 220. They indicate that when an excess amount is too large, the end portion temperature in starting the fixing device decreases. As a result, in the fixing processing of the first sheet performed immediately after the temperature of the fixing device has reached a fixing temperature, the fixation properties at the recording paper end portion decrease. Consequently, to ensure the fixation properties while reducing the temperature decrease of the end portion in starting the fixing device, the excess amount is to be reduced.

In the present exemplary embodiment, the heating area DE of the heater 300 and the pressure area H of the sheet 220 are approximately the same, and consequently, both of the fixation properties at the recording paper end portion and the reduction in the non-sheet-passing part temperature rise by the sheet can be achieved. Further, in the present exemplary embodiment, the positional accuracy of the pressure area H is high, and consequently, the setting accuracy of the excess amount is also high.

Hereinafter, a second exemplary embodiment of the present invention will be described with reference to FIGS. 8, 9A, and 9B. In the present exemplary embodiment, to components described in the above-described first exemplary embodiment, the same reference numerals are applied. Descriptions about the components and functions similar to those in the first exemplary embodiment are omitted and only features in the present exemplary embodiment will be described. This similarly applies to the third exemplary embodiment and the subsequent exemplary embodiments.

Figure 8:
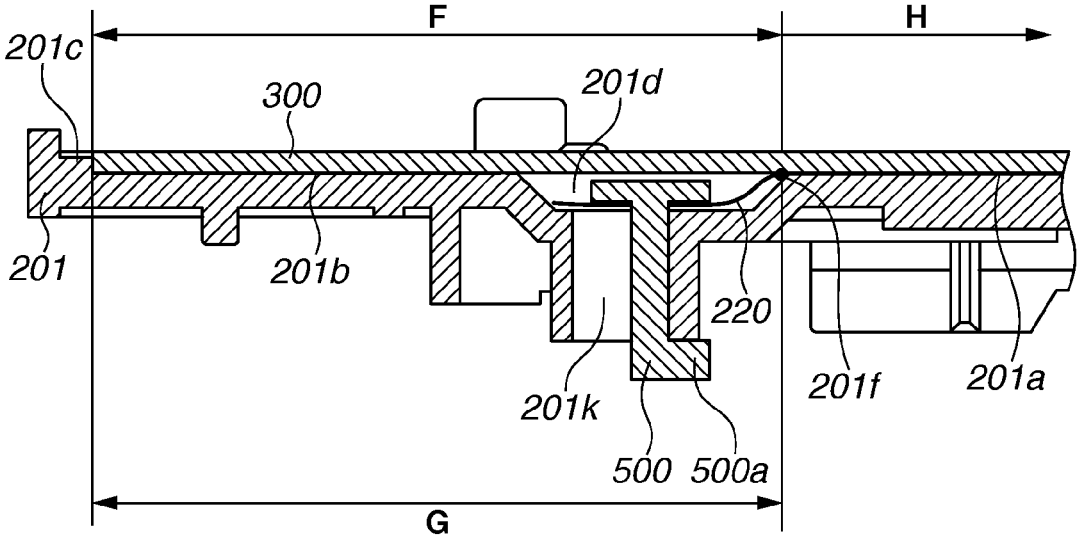
FIG. 8 is a cross-sectional view illustrating a relationship among a heater, a high thermal conductive member, and a heater holding member according to a second exemplary embodiment.
Figure 9A:
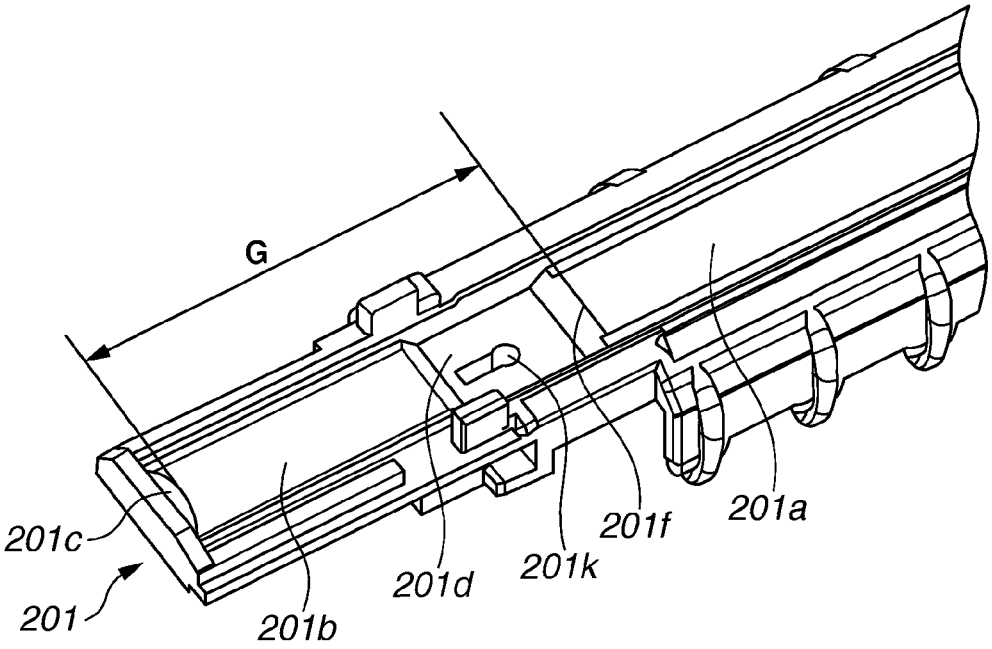
FIGS. 9A and 9B are perspective views illustrating a relationship between the high thermal conductive member and the heater holding member.
Figure 9B:
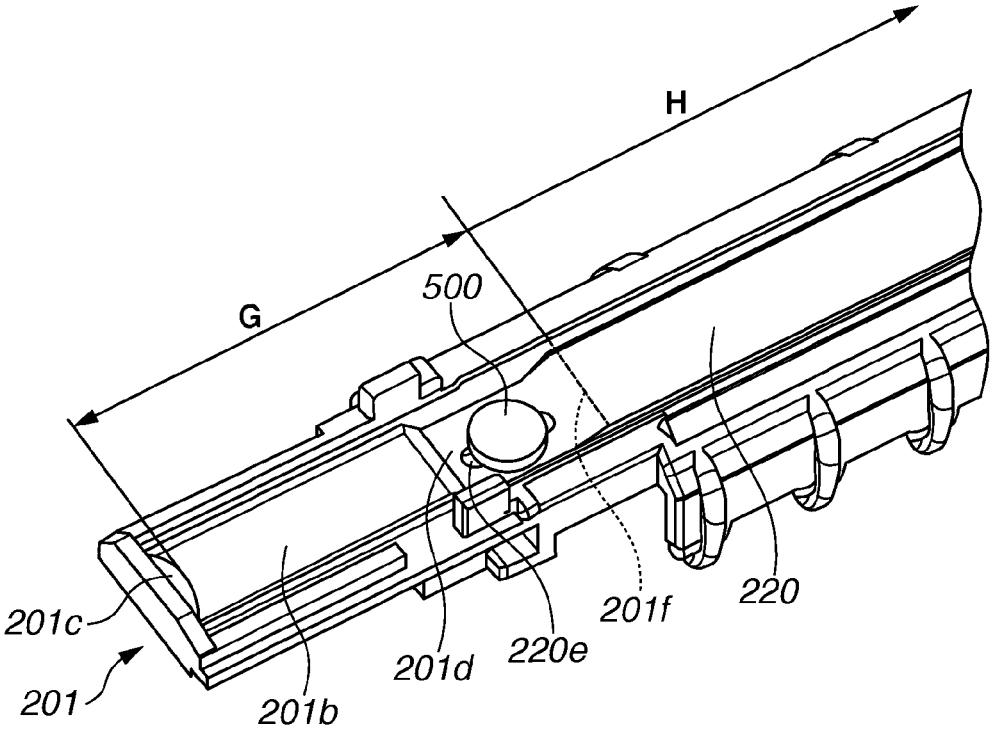

With reference to FIGS. 8, 9A, and 9B, a positional relationship among the heater holding member 201, the sheet 220, and the heater 300 will be described. In the following description, description of one end portion will be made and the other end portion side has a similar structure. FIG. 8 is a cross-sectional view illustrating a longitudinal direction end portion area of the heater holding member 201. FIGS. 9A and 9B are perspective views illustrating the longitudinal direction end portion area of the heater holding member 201. FIG. 9A illustrates only the heater holding member 201, and FIG. 9B illustrates a state in which the sheet 220 is attached to the heater holding member 201.

To the heater holding member 201 according to the present exemplary embodiment, the back clearance portion (recessed portion) 201*d* that is recessed from the heater attachment surface 201*a* is provided. The back clearance portion 201*d* has a hole 201*k* for the installation of the sheet 220. An end portion of the sheet 220 has a long hole 220*e*. A stopper 500 is passed through the long hole 220*e* and the hole 201*k* to attach the sheet 220 to the heater holding member 201. The stopper 500 has a hook portion 500*a*, and after attaching to the heater holding member 201, the hook portion 500*a* is rotated by 180 degrees. This causes the stopper 500 to hook to the heater holding member 201, and the stopper 500 is prevented from coming out of the holding member 201. The sheet 220 is regulated by the long hole 220*e* in the widthwise direction (y direction). The longitudinal direction position of the sheet 220 has a certain degree of freedom since the stopper 500 holds the sheet 220 with a clearance. Since the stopper 500 does not come out of the holding member 201 with the hook portion 500*a*, in the assembly of the apparatus, the sheet 220 does not come out of the holding member 201.

Figure 10:
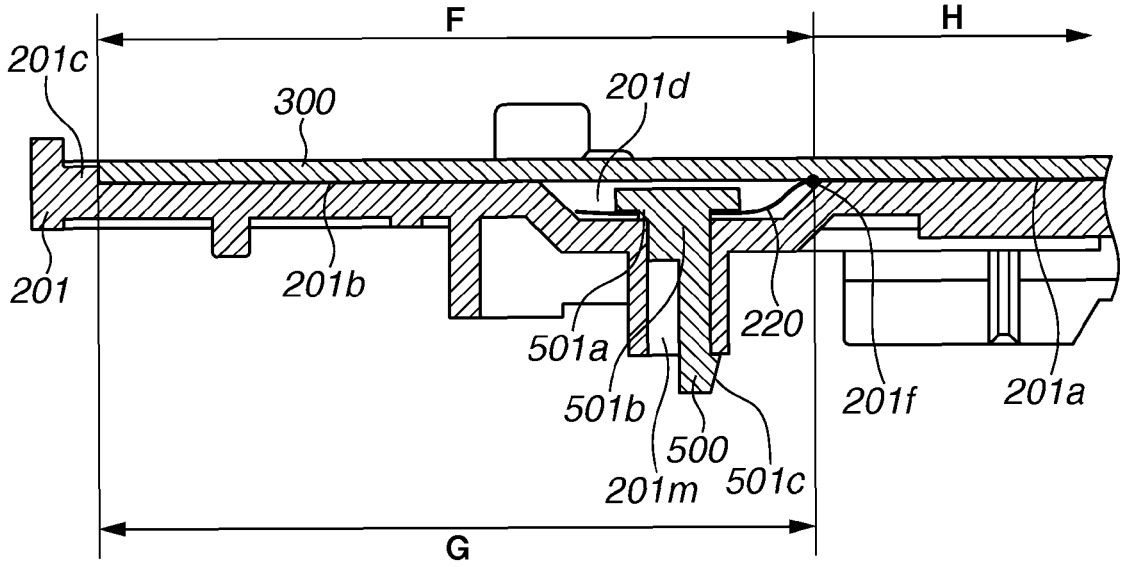
FIG. 10 is a cross-sectional view illustrating a relationship among a heater, a high thermal conductive member, and a heater holding member according to a third exemplary embodiment.
Figure 11A:
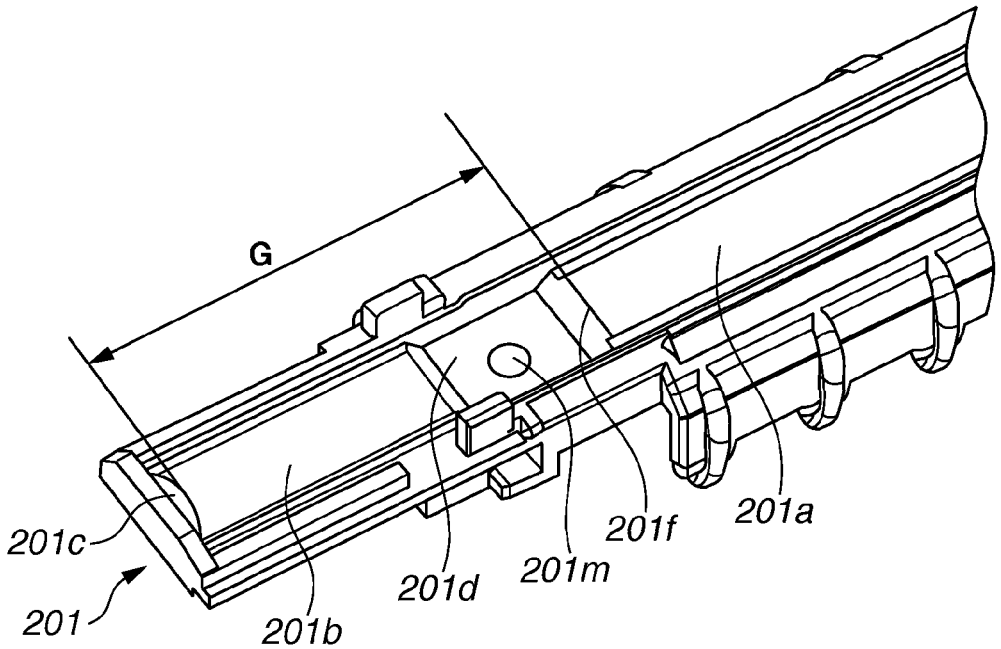
FIGS. 11A and 11B are perspective views illustrating a relationship between the high thermal conductive member and the heater holding member.
Figure 11B:
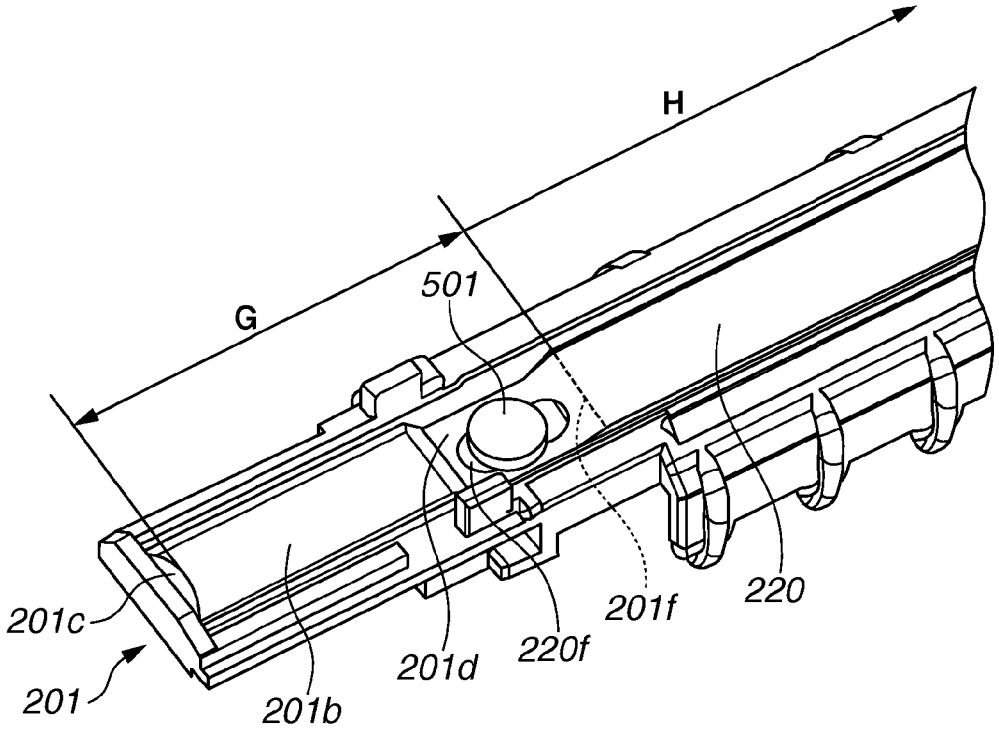

Hereinafter, a third exemplary embodiment of the present invention will be described with reference to FIGS. 10, 11A, and 11B. To the heater holding member 201 according to the present exemplary embodiment, the back clearance portion (recessed portion) 201*d* that is recessed from the heater attachment surface 201*a* is provided. The back clearance portion 201*d* has a hole 201*m* for installing the sheet 220. An end portion of the sheet 220 has a long hole 220*f*. A stopper 501 is passed through the long hole 220*f* and the hole 201*m* to attach the sheet 220. The stopper 501 has a positioning portion 501*a* for positioning the sheet 220, a positioning portion 501*b* for positioning the stopper 501 itself to the heater holding member 201, and a hook portion 501*c*. The sheet 220 is regulated by the long hole 220*f* in the widthwise direction (y direction). The longitudinal direction position of the sheet 220 has a certain degree of freedom since the stopper 501 holds the sheet 220 with a space. Since the stopper 501 does not come out of the holding member 201 with the hook portion 501*c*, in the assembly of the apparatus, the sheet 220 does not come out of the holding member 201.

Figure 12:
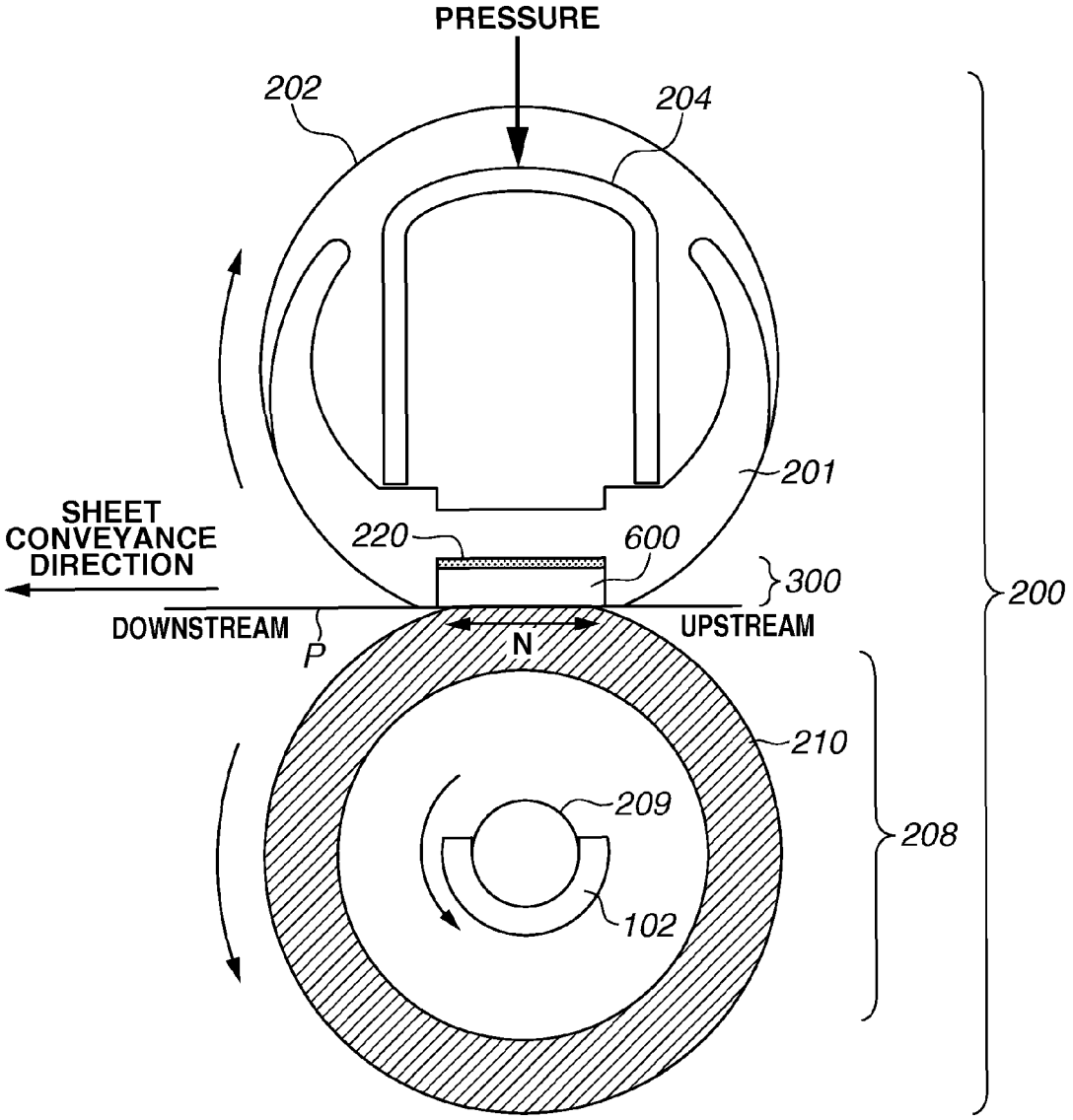
FIG. 12 is a cross-sectional view illustrating a modification of the image heating device.

In the above-described first to third exemplary embodiments, as the backup member, the heater 300 is used. The backup member may be a substrate (for example, a ceramic substrate) 600 without a heating element. To a structure in which the high thermal conductive member 220 is provided between the backup member 600 and the holding member 201, the holding structure for the sheet 220 according to one of the first to third exemplary embodiments may be applied. FIG. 12 illustrates an example of such structure. In this structure, a conductive layer is provided on the film 202 to generate heat in the electromagnetic induction heating. Further, the exemplary embodiments of the present invention can be applied to an apparatus having a structure in which a halogen heater is provided inside the tube of the film.

In the first to third exemplary embodiments, as the moving member, the cylindrical film is used as an example. The exemplary embodiments of the present invention can be applied to an apparatus having a take-up film as the moving member, as an alternative to the cylindrical firm.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2013-248454 filed Nov. 29, 2013, which is hereby incorporated by reference herein in its entirety.

What is claimed is:

1. An image heating device comprising:

a cylindrical film;

a heater configured to contact an inner surface of the film;

a nip portion forming member contacting an outer surface of the film and forming a nip portion in cooperation with the heater via the film;

a thermal conductive sheet contacting a surface of the heater opposite to a surface of the heater contacting the film; and a holding member configured to hold the heater, the thermal conductive sheet being interposed between the holding member and the heater, wherein the recording material on which an image has been formed is heated by heat from the film while being nipped and conveyed at the nip portion, and wherein the holding member includes a first surface sandwiching the thermal conductive sheet with the heater and pressing the thermal conductive sheet against the heater, and a second surface, facing the thermal conductive sheet, provided adjacent to the first surface in a longitudinal direction of the heater, the second surface being recessed more than the first surface in a direction away from the heater.

2. The image heating device according to claim 1, wherein a longitudinal end of the thermal conductive sheet extends to the outside of the first surface in the longitudinal direction.

3. The image heating device according to claim 2, wherein the heater includes a substrate and a heating element formed on the substrate, and the second surface is formed on an area of the holding member outside of an area, in the longitudinal direction, where the heating element is disposed.

4. The image heating device according to claim 2, wherein a longitudinal end of the nip portion forming member extends to an area of the holding member where the second surface is formed.

5. The image heating device according to claim 1, further comprising a stopper inserted into the holding member for preventing from the thermal conductive sheet coming off from the second surface, the thermal conductive sheet being interposed between the stopper and the second surface.

6. The image heating device according to claim 5, wherein the thermal conductive sheet has a hole through which the stopper is passed.

7. The image heating device according to claim 6, wherein the hole is a long hole which is long in the longitudinal direction.

8. The image heating device according to claim 1, wherein the holding member has a third surface contacting the heater, the third surface being provided outside the second surface in the longitudinal direction.

9. The image heating device according to claim 1, wherein the film has a conductive layer that generates heat by supplying power thereto.

10. An image heating device comprising:

a cylindrical film;

a backup member configured to contact an inner surface of the film;

a nip portion forming member contacting an outer surface of the film and forming a nip portion in cooperation with the backup member via the film;

a thermal conductive sheet contacting a surface of the backup member opposite to a surface of the backup member contacting the film; and a holding member configured to hold the backup member, the thermal conductive sheet being interposed between the holding member and the backup member, wherein the recording material on which an image has been formed is heated by heat from the film while being nipped and conveyed at the nip portion, and wherein the holding member includes a first surface sandwiching the thermal conductive sheet with the backup member and pressing the thermal conductive sheet against the backup member, and a second surface, facing the thermal conductive sheet, provided adjacent to the first surface in a longitudinal direction of the backup member, the second surface being recessed more than the first surface in a direction away from the backup member and having a hole through which the thermal conductive sheet is passed.

11. The image heating device according to claim 10, wherein a width of the thermal conductive sheet at an end portion thereof in the longitudinal direction is narrower than that at a central portion thereof.

12. An image heating device comprising:

a cylindrical film;

a backup member configured to contact an inner surface of the film;

a nip portion forming member contacting an outer surface of the film and forming a nip portion in cooperation with the backup member via the film;

a graphite sheet contacting a surface of the backup member opposite to a surface of the backup member contacting the film; and a holding member configured to hold the backup member, the graphite sheet being interposed between the holding member and the backup member, wherein the recording material on which an image has been formed is heated by heat from the film while being nipped and conveyed at the nip portion, and wherein the holding member includes a first surface sandwiching the graphite sheet with the backup member and pressing the graphite sheet against the backup member, and a second surface, facing the graphite sheet, provided adjacent to the first surface in a longitudinal direction of the backup member, the second surface being recessed more than the first surface in a direction away from the backup member.

13. An image heating device comprising:

a cylindrical film;

a backup member configured to contact an inner surface of the film;

a nip portion forming member contacting an outer surface of the film and forming a nip portion in cooperation with the backup member via the film;

a graphite sheet contacting a surface of the backup member opposite to a surface of the backup member contacting the film; and a holding member configured to hold the backup member, the graphite sheet being interposed between the holding member and the backup member, wherein the recording material on which an image has been formed is heated by heat from the film while being nipped and conveyed at the nip portion, and wherein the device includes a first portion in which the graphite sheet is interposed and pressed between the holding member and the backup member, and a second portion, provided adjacent to the first portion in a longitudinal direction of the backup member, in which the graphite sheet is interposed between the holding member and the backup member, the second portion being configured either so that the graphite sheet is pressed between the holding member and the backup member with pressure smaller than that in the first portion or so that the graphite sheet is not pressed between the holding member and the backup member.

14. The image heating device according to claim 13, wherein the backup member is a heater, the heater contacting an inner surface of the film and forming the nip portion with the nip portion forming member via the film.

* * * * *